United States Patent [19]

Bahry et al.

[11] 4,142,389

[45] Mar. 6, 1979

[54] CYLINDER LOCK

[76] Inventors: Abraham Bahry; Moshe Dolev, both of 45 Sokolov St., Holon, Israel

[21] Appl. No.: 848,078

[22] Filed: Nov. 3, 1977

[30] Foreign Application Priority Data

Nov. 24, 1976 [IL] Israel ..... 50984

[51] Int. Cl.[2] ..... E05B 27/00

[52] U.S. Cl. ..... 70/359

[58] Field of Search ..... 70/359, 358, 364 A, 70/419, 421

[56] References Cited

U.S. PATENT DOCUMENTS

| | | | |
|---|---|---|---|
| 593,436 | 11/1897 | Rydberg | 70/359 |
| 1,095,500 | 5/1914 | Hansen | 70/359 |
| 2,022,070 | 11/1935 | Williams | 70/421 |

*Primary Examiner*—Robert L. Wolfe

*Attorney, Agent, or Firm*—Alter and Weiss

[57] ABSTRACT

A dual pin tumbler lock and a key having two planar faces wherein the two planar faces of the key blade have similar concentric projections and depressions on both sides of a longitudinal axis for operating the lock, regardless of into which side of the dual lock the key is placed, and wherein each tumbler of the fixed part of the lock is made of two parts — one part telescopically slidable within the other, both parts being urged by springs against a corresponding tumbler housed in the rotating cylinder which corresponding tumbler is likewise made of two telescopic parts.

6 Claims, 2 Drawing Figures

CYLINDER LOCK

The present invention concerns locks, and more particularly cylinder locks.

The known locks of this type comprise generally approximately five spring loaded pin-tumblers, which must be depressed by the proper projections in a key in order that the cylinders of the locks may be rotated.

It is an object of the present invention to increase the positions, permutations, and combinations of said pin-tumblers to such an extent that the locks will be more difficult to pick than has been possible with the locks known up to now.

One exemplary embodiment of the invention comprises a pin-tumber lock characterized in that each tumbler within the fixed part of the lock is divided into two concentric parts, one telescopically slidable inside the other and both being urged by separate springs against the tumbler housed in the rotating cylinder, said tumbler being likewise made of two parts, one slidable within the other. A key having concentric projections on both sides of the longitudinal axes of both planar faces. The concentric projection on one side of the axis on one planar face always aligns with the concentrically telescopically sliding tumblers of a dual lock to move the tumblers of the cylinder for enabling rotation thereof, regardless of which part of the dual lock is operated.

Figure 1:
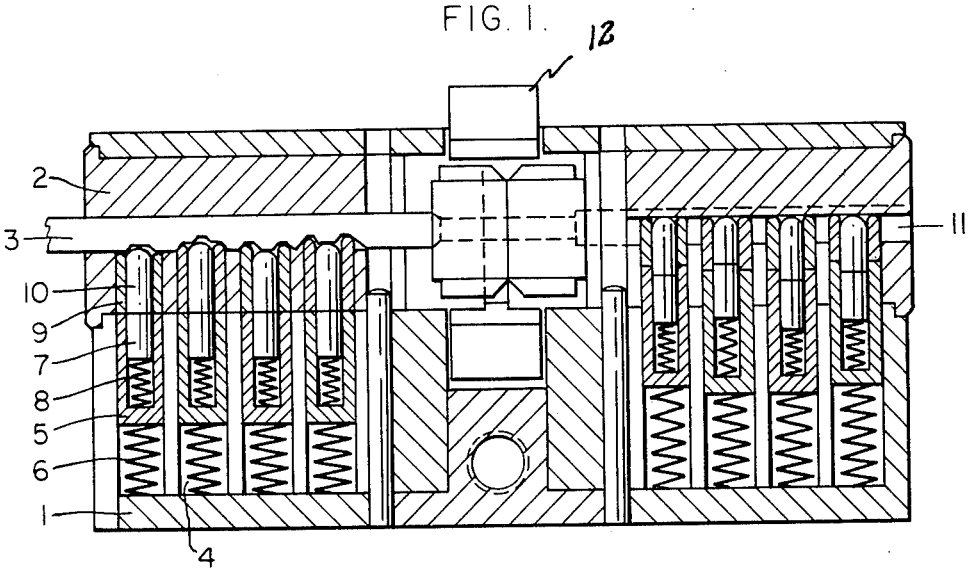
Figure 2:
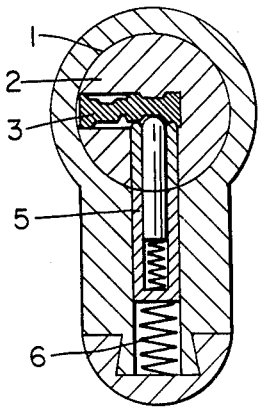

The above-mentioned and other objects and features of the invention and the manner of attaining them will become more apparent, and the invention itself will be best understood by reference to the following description of an embodiment of the invention taken in conjunction with the accompanying drawings, in which:

FIG. 1 is a longitudinal cross-section of the cylinder lock according to the invention and FIG. 2 is a vertical section therethrough.

The cylinder lock here illustrated is a dual lock, i.e. one that can be operated from either side. Only one side will be described hereinafter, it being understood that the other side will be the same.

The lock comprises a housing 1 in which a cylinder 2 is rotatable by means of a key 3 as known per se. The housing, i.e. the fixed part of the lock and the rotatable cylinder 2 are provided with four cylindrical bores, such as bore 4, in which the pin-tumblers according to the invention are housed. These pin-tumblers are constituted by two concentric parts, i.e. a cylindrical outer part 5 which is urged by means of spring 6 housed in space 4 towards cylinder 2 and an inner part or pin which is telescopically slidable within outer part 5 and is likewise urged by a spring 8 towards cylinder 2.

Within the radial bores in cylinder 2 outer sleeves 9 and inner pins 10 are provided, the pins being slidable within the sleeves. The height of the sleeves and pins is predetermined according to the combination of the lock, as known per se. A key 3 having the proper profile, i.e., preferably concentric protuberances and recesses on its planar faces depresses said sleeves 9 and pins 10 so that their bottom ends are properly aligned and make the rotation of that cylinder possible, as known per se. When the rotatable cylinder can be rotated, it moves a locking cam 12 from a locked to an unlocked position.

In operation, the lock is normally in the locked position with the sleeves 5 and pins 7 extending into rotatable cylinder 2. The proper key inserted into the lock forces the sleeves 9 and pins 10 to move the sleeves 5 and pins 7 from the aligned radial bores of cylinder 2, thereby unlocking the lock.

The key is preferably provided with the proper profile at both sides of each planar face so that said key may be inserted in any position in either keyhole 11 of the dual lock 3.

It can be seen that within the cylinder lock according to the invention extremely large numbers of combinations are possible since both the sleeve 9 and pin 10 of eaach tumbler can be set to a different position.

It is, of course, understood that it is within the scope of the present invention to provide a tumbler lock having less or more than four tumblers. Furthermore, it must be understood that the invention can be used in any lock which comprises a cylinder and tumblers; e.g., pad locks, cam locks and the like.

While the principles of the invention have been described above in connection with specific apparatus, it is to be clearly understood that this description is made only by way of example and not as a limitation on the scope of the invention.

We claim:

1. A dual pin tumbler lock,
said lock comprising a housing,
a cylinder within said housing,
said cylinder rotatable by key means,
said key means having two oppositely disposed planar faces,
first bore means in said cylinder for receiving pin tumblers therein,
said first bore means having the axes thereof substantially normal to the axis of said cylinder,
second bore means in said housing for receiving pin tumblers therein,
said second bore means aligned with said first bore means,
first tumbler means in said first bore means,
second tumbler means in said second bore means,
said first and second tumbler means comprising cylindrical outer parts and concentric inner parts telescopically slidable within the outer parts,
means in said housing for forcing said second tumblers into said aligned first bores to thereby prevent rotation of said cylinder, and
said key means comprising concentric projections and/or recesses on each side of a longitudinal axis on each of said planar faces for aligning said pin tumblers for moving said first pin tumblers to force said second tumblers out of said first bores, whereby said cylinder becomes rotatable, regardless of the orientation of the key means and regardless of into which of the dual locks the key is inserted.

2. The pin tumbler lock of claim 1 wherein said means in said housing for forcing said second tumblers into said first bore means comprises spring means.

3. The pin tumbler lock of claim 2 wherein said spring means comprises first spring means located below said cylindrical outer part of said second tumblers to force said cylindrical outer part into said aligned first bore means.

4. The pin tumbler lock of claim 3 wherein the outer and inner parts of said first and second tumblers are aligned respectively and wherein said spring means further comprises second spring means located within said cylindrical outer part of said second tumblers for forcing said inner part to telescopically slide from said cylindrical outer part of said second tumblers into said aligned first tumbler.

5. The pin tumbler lock of claim 3 wherein said spring means comprises a first spring and a second spring, said first spring being positioned to force said outer cylindrical portion of said second tumbler into said first bore, and a second spring for forcing said inner tumbler means to slide within said first cylindrical part of said second tumbler partially into the outer cylindrical part of said first tumblers.

6. The pin tumbler lock of claim 1 wherein said key means comprises a planar profile which depresses both said outer cylindrical part and said inner part of said first tumbler to force said second tumblers from said first bores for enabling rotation of said cylinder.

* * * * *

UNITED STATES PATENT AND TRADEMARK OFFICE

CERTIFICATE OF CORRECTION

PATENT NO. : 4,142,389

DATED : March, 6, 1979

INVENTOR(S) : Abraham Bahry; Moshe Dolev

It is certified that error appears in the above-identified patent and that said Letters Patent are hereby corrected as shown below:

| | |
|---|---|
| Col. 1, line 51 | After "part or pin" insert --7--. |
| Col. 2, line 11 | "eaach tumber" should be --each tumbler--. |

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*